United States Patent [19]

Carmer

[11] Patent Number: 5,042,089

[45] Date of Patent: Aug. 27, 1991

[54] DRESS SHIELD ARTICLE

[76] Inventor: Patricia A. Carmer, 6551 Wandsworth Cr., Indianapolis, Ind. 46250

[21] Appl. No.: 456,506

[22] Filed: Dec. 26, 1989

[51] Int. Cl.[5] ..... A41C 3/00; A41D 27/13

[52] U.S. Cl. ..... 2/55; 2/73; 450/86

[58] Field of Search ..... 2/55, 71, 72, 73, 90, 2/106, 110, 115, 125, 109; 450/1, 86

[56] References Cited

U.S. PATENT DOCUMENTS

| | | | |
|---|---|---|---|
| 80,421 | 1/1905 | Guinzburg | 2/55 |
| 542,991 | 7/1895 | Crout | 2/55 |
| 567,285 | 9/1896 | Wormer | 2/55 |
| 667,725 | 2/1901 | McClain | 2/55 |
| 715,743 | 12/1902 | Basch | 2/55 |
| 722,395 | 3/1903 | Basch | 2/55 |
| 1,237,864 | 8/1917 | Gross | 2/110 |
| 2,252,234 | 8/1941 | Siegel | 2/125 X |
| 2,643,385 | 6/1953 | Engel | 2/90 X |
| 2,836,826 | 6/1958 | Geiss | 2/125 |
| 3,421,514 | 1/1969 | Friedlander | 450/86 X |

FOREIGN PATENT DOCUMENTS

| | | | |
|---|---|---|---|
| 451242 | 4/1913 | France | 2/55 |
| 1024637 | 3/1953 | France | 2/55 |
| 6459 | 3/1908 | United Kingdom | 2/55 |

*Primary Examiner*—Werner H. Schroeder

[57] ABSTRACT

A dress shield article, comprising the combination of a brassiere and a pair of dress shields connected to the brassiere, the brassiere having at each of its lateral sides an over-the-shoulder strap and a back strap leading around the torso of the user, with a composite band of perspiration-absorbing material formed into a sort of cylindrical shape and affixed to the brassiere's laterally outward sides by stitching to the brassiere's straps and to the laterally outer edge of the brassiere.

10 Claims, 2 Drawing Sheets

DRESS SHIELD ARTICLE

FIELD OF THE INVENTION

The present invention relates to clothing accessories, and more particularly relates to items often called "dress shields" which for many years have been provided for women's problems of under-arm perspiration.

Still more particularly, the invention relates to means for providing and supporting an accessory of dress shield nature with its perspiration-absorbing material in proper locations adjacent a woman's under-arm area.

SUMMARY OF THE INVENTION

Providing advantages and avoiding disadvantages of such items as dress shields, the present invention provides a combination article, i.e., perspiration-absorbing material such as would be in dress shields but here more in the nature of a pair of dress shields in combination with a brassiere.

A generally cylindrical band of the absorbent material extends from edges of the brassiere, i.e., from each lateral side, from the band extending upwardly from the brassiere's horizontal strap, and downwardly from the brassiere's strap that goes up and over the woman's shoulder; and a couple of absorbent material panels, connected to one another and to that band mentioned above, provide the perspiration absorbtion.

The various panels, although formed from flat pieces, provide, when connected, a generally cylindrical shape, for encircling the shoulder of the user, and a generally cylindrical shape for encircling the upper part of the user's respective arm, thus providing what in effect is more than a combination of a brassiere and a pair of dress shields connected to the brassiere.

More details are specified in the more detailed description herein.

The Prior Art has tried different solutions to the problem of the provision of dress shields for women's clothing The prior art has used various means of providing the presence of perspiration-absorbing material for a woman's under-arm area.

For example, one method is to pin, or baste, or even button, a piece of perspiration-absorbing material to a woman's dress or blouse.

Another method is the provision of some sort of pocket in the dress or blouse, which provides a retainer for the piece of perspiration-absorbing material as a dress shield.

Still another type of perspiration shield device for women's clothing protection are jacket-type garments of various types sold by Kleinerts Inc. (of P. O. Box 560, Elba, Ala.). The Kleinert garments are advertised as to be worn either with or without a brassiere; for, quite in contrast to the present invention of panels connected to the woman's brassiere and supported wholly by the brassiere, i.e., supported by the woman's body only indirectly through the brassiere, all types of the Kleinerts jackets are of full enough jacket nature such that they are supported only by the woman's body and not supported by the brassiere at all.

Thus, the Kleinerts jackets, although providing perspiration shields by absorbent panels in the armpit region, and although the Kleinerts jackets' advertising expressly considers a relation to a brassiere, those relations to factors related to the present invention's concepts seem to be not only things which show definable differences from the present invention but indeed to help emphasize the non-obvious and inventive nature of the present invention, especially when this prior art is considered along with other prior art factors are considered.

Accordingly, the existence of such articles of the prior art is not only conceded, it is emphasized; for it is with similarities to such prior concepts that the present inventive concepts build, accomplishing an article of a construction significantly different than just the components and operativities of the long-known articles of the prior art, and thus the inventive significance of the present concepts is emphasized, and the nature of the concepts and their results can perhaps be easier understood.

The invention's components and concepts are similar to those available in the prior art, except for the present concepts in particular In a hindsight consideration of the present invention to determine its inventive and novel nature, it is not only conceded but emphasized that the prior art had details usable in this invention if the prior art had had the guidance of the present concepts.

That is, it is emphasized that the prior art had several particulars:

a. The prior art has provided panels of perspiration-absorbing material, with different means of providing them to be located in a woman's under-arm area.

b. The prior art has used articles of the woman's apparel as a support or locator of the perspiration-absorbing material, particularly a dress or blouse as such support or locator item of apparel;

c. As a conventional article of most women's apparel, a brassiere has been a commonly-used article of women's apparel, and they have always had portions adjacent the under-arm area which could have been used for such a supportive or locator function of perspiration-absorbent material;

d. In comparison to apparel items, e.g., dresses and blouses, brassieres have always been able to provide distinct advantages such as (1) not having to alter the many dresses and blouses of a woman's wardrobe, in order to achieve an perspiration absorbency function, for the possession of only a very few articles of the present invention provides, in effect, that the woman's entire wardrobe has been provided with dress shields; (2) a brassiere article of the present invention can be easily and thoroughly washed, whereas many blouses and dresses are of a material preventing such washing unless the dress shield is removed, requiring not only that task of removal but a subsequent reattachment; (3) a very few brassiere articles of the present invention provide for a woman's wardrobe a full and ever-present assurance against the embarrassment of the result having forgotten to have reattached a dress shield to a blouse or dress, which result would be a bother and loss of confidence of the woman; etc.

Accordingly, the various dress shield concepts and components are conceded and emphasized to have been widely known in the prior art, and the advantages of use of a brassiere as a supporter or locator of perspiration-absorbing material have always been available; nevertheless, the prior art not having had such concepts, even only a fair amount of realistic humility, to avoid consideration of this invention improperly by hindsight, requires the concepts and achievement here to be realistically viewed as inventive in their nature.

BRIEF DESCRIPTION OF THE DRAWINGS

The above description of the novel and advantageous combination article of the present invention is of somewhat introductory and generalized form. More particular details, concepts, and features are set forth in the following and more detailed description of an illustrative embodiment, taken in conjunction with the accompanying drawings, which are of somewhat schematic and diagrammatic nature, as the concepts of the present invention are illustrated in this embodiment.

In the drawings

FIG. 3 illustrates the sewing which connects the elastic strip to the panel body having been done while the inner edge portion of the body panel was pushed longitudinally inwardly to provide a puckered or gathered (relatively short) condition of the panel body which, when the size-adjustment is desired to be relatively long, permits the panel body portion to be lengthened longitudinally of the upper brassiere strap, as indicated by the greater distance of the reference letters A and B in FIG. 4 in comparison to that of FIG. 3;

FIG. 5 is a view of one of the body members of the dress shield, an it is the member which is most-outwardly from the brassiere, in comparison to the members shown in FIGS. 6 and 7; and FIGS. 6 and 7, respectively, are body members which, when connected together as shown in FIGS. 1 and 2, provide a dress shield material piece which is the one most-inwardly of the brassiere, i.e., would provide a carrier body for the outermost panel body member shown in FIG. 5.

DETAILED DESCRIPTION OF THE ILLUSTRATIVE EMBODIMENT

Figure 1:
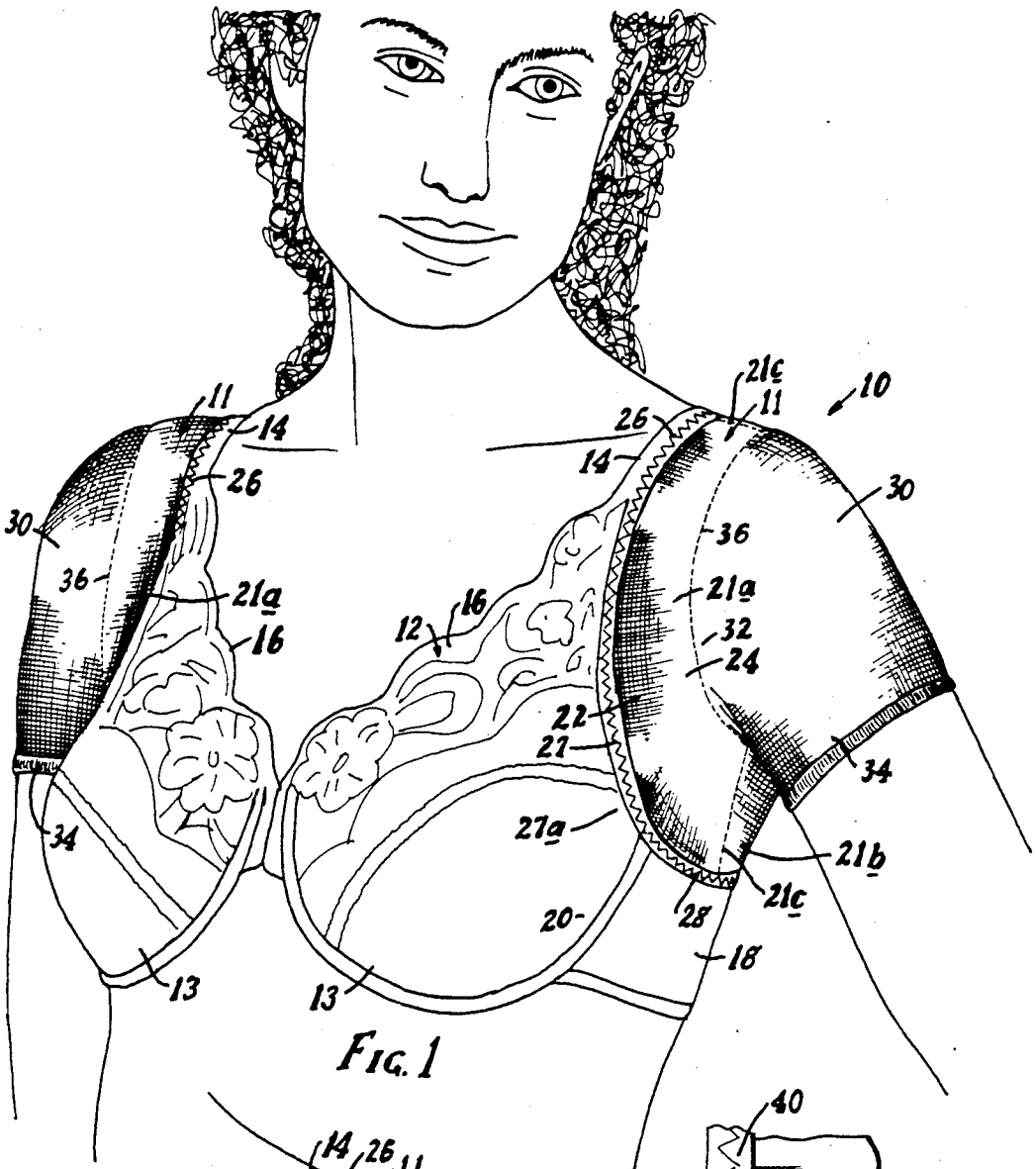
FIG. 1 is a pictorial view of a composite assembly of a conventional brassiere having operatively connected thereto, at each lateral side of the brassiere, a perspiration-absorbent body member of the present invention.

As shown in the drawings, this invention provides a desired and advantageous solution to an often-present problem of social-conscious women, i.e., the problem of underarm perspiration, and its unsightliness and harms to the women's dress, blouse, or sweater.

Thus, the invention provides a dress shield article 10, in the form of perspiration-absorbing material partly of the form of a body member 11, shown as extending over a woman's shoulder, under her arm pit, and around the upper end of her arm, and connected to the brassiere 12, with other details specified herein.

The brassiere 12 is shown merely illustratively; for the brassiere, except as it is in the combination as herein set forth, the brassiere itself is not part of the invention, and thus is here shown a conventional brassiere 12 having at each side a breast cup 13 and a pair of support straps.

Straps 14 which for identification are called a first strap 14 of the brassiere 12, on each side of the brassiere 12, are an upper brassiere support strap 14, which extend upwardly from an upper part 16 of the respective breast cup 13, for going over the respective shoulder of the user, and thus sometimes referred to herein as the brassiere's "over-the-shoulder" strap 14.

Straps 18 which for identification are called a second or back strap 18 of the brassiere 12, on each side of the brassiere 12, are generally horizontal support straps 18, which extend rearwardly from an outer part 20 of the respective breast cup 13, for going around the torso of the user.

As so described, the straps 14 and 18 are conventional, as is the fact that each of the strap sets 14 and 18, quite conventionally, are operatively connected to one another at a connection location rearwardly of the user.

Figure 6:
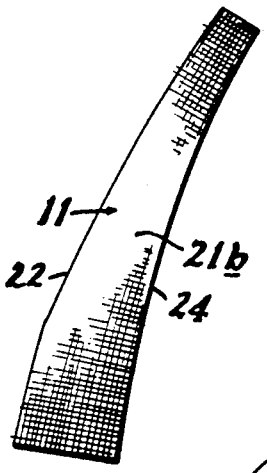
FIGS. 5, 6, and 7, are views of the dress shield panel body pieces, as shown in flat view as the pieces would have been cut from a sheet of the perspiration-absorbent material, two of each of the pieces of FIGS. 5, 6, and 7, being required for the two sets needed; and more particularly.
Figure 7:
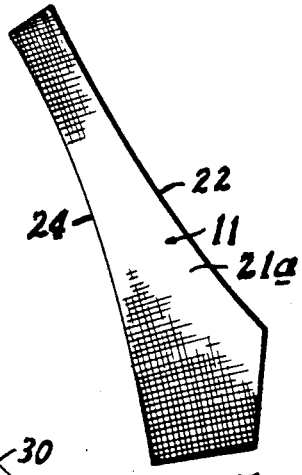
Figure 5:
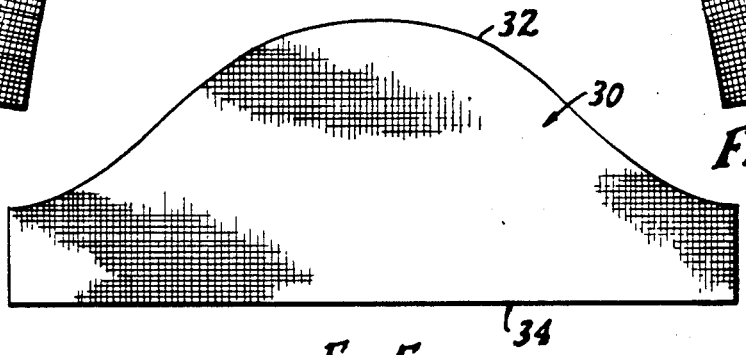

At each lateral side of the brassiere 12, there is attached one of the first type dress shield panels 11. More particularly as to each of them, and as shown in FIGS. 6 and 7, each of inner pieces 1 is formed of two similar bodies 21*a* and 21*b*, those panel bodies 21*a* and 21*b* each having two opposed edges, the inner one referred to as edge 22 and the outer one referred to as edge 24; and the inner one 22 of those edges is connected to the brassiere 12 by sewing connection 26 along the brassiere's first strap 14 and by sewing connection 27 along the brassiere's laterally outward edge 27, and by connection sewing 28 along the brassiere's second strap 18, and forming a generally cylindrical shape, for encircling the shoulder of the user.

The end edges of the body portions 21*a* and 21*b* are joined by sewing connections 21*c*.

Also as shown there are provided at each lateral side a second dress shield panel 30 having two opposed edges, the inner one referred to as 32 and the outer one as edge 34.

This panel 30's outer edge 34 encircles the user's arm; but the inner edge 32 of panel body 30 is sewn (36) to the outer edge 24 of the composite panel body 11. Thus the outer panel body 30 forms a generally cylindrical shape for encircling the upper part of the user's arm and over her shoulder, with the absorbent panel members 11 and 30 providing perspiration-absorbency over all the lady's shoulder and armpit area.

The panels 11 and 30 thus quite effectively provide a generally cylindrical band of perspiration-absorbent material extending from each lateral side of the brassiere, as a composite unit 10, the band extending generally laterally outwardly from the brassiere's upper strap 14 and generally laterally and upwardly from the brassiere's second strap 18.

Figure 2:
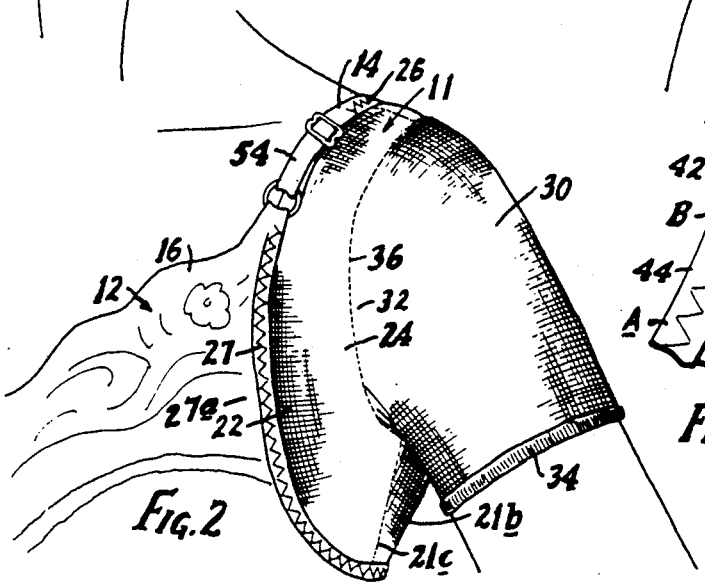
FIG. 2 is a pictorial detail view, pictorially illustrating a dress shield body for the left side of the brassiere, generally according to the embodiment shown in FIG. 1, except that the embodiment of FIG. 2 is provided to have a size-adjustment feature not shown in the embodiment of FIG. 1.
Figure 3:
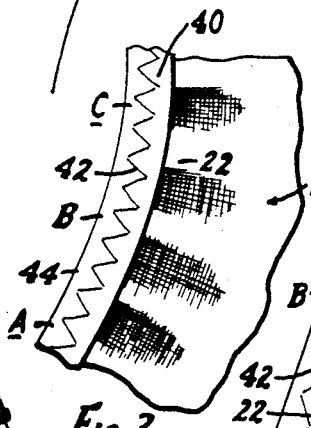
FIGS. 3 and 4, respectively, are fragmental detail views, on a considerably enlarged scale in comparison to FIGS. 1 and 2, FIGS. 3 and 4 illustrating a pair of the size-adjustment feature of FIG. 2, and more particularly showing a portion of the edge of the laterally-inner absorbent panel body and a short elastic adjustment strip sewed thereto, that adjustment strip portion of the panel body being not connected to the adjacent over-the-shoulder strap of the brassiere; and more particularly.
Figure 4:
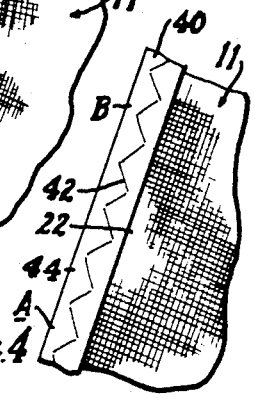
Figure 8:
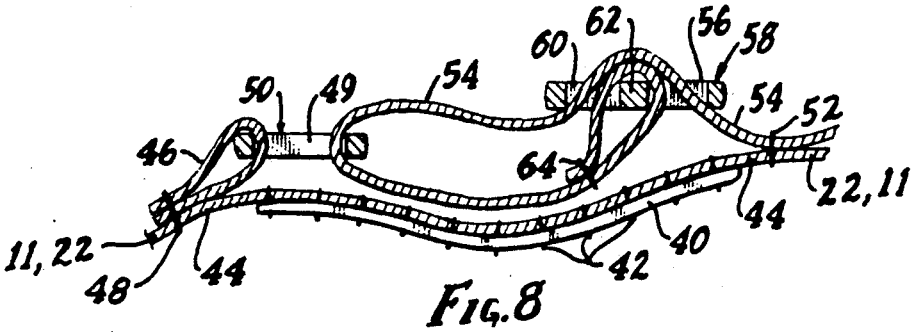
FIG. 8 is an enlarged, cross-sectional detail view off the size-adjustment feature of FIG. 2.
Figure 9:
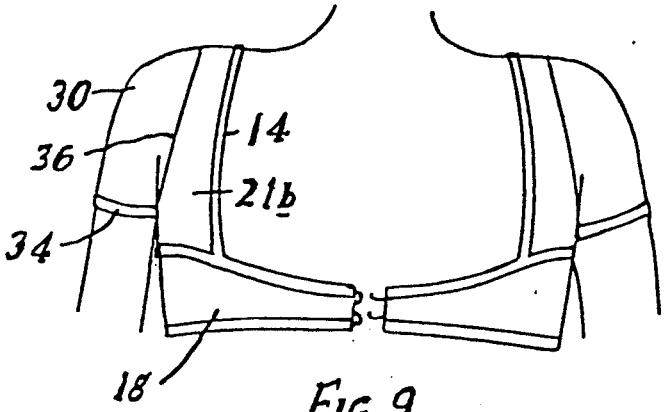
Figure 10:
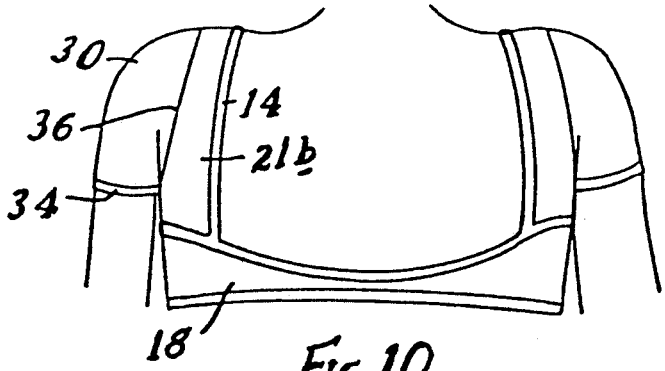

The size-adjustment feature, shown in FIGS. 2 and 8, provides for size-adjustment by means providing that the inner edge 22 of the composite panel body 11, and the upper brassiere strap 14, are made adjustable in length.

More particularly as shown (FIG. 8), there is an elastic strip 40 sewn (42) onto the under-side of a portion 44 of the inner panel edge 22, that portion 44 of edge 22 being not sewn to either the upper brassiere strap 14 or the brassiere's outer edge 27*a*.

Adjacent one end of the portion 44 of the panel edge 22 there is shown a loop member 46 which is sewn (48) to that panel edge 22, the loop 46 passing through the open center 49 of a ring-like member 50.

From the opposite end of the adjustment portion 44 of panel edge 22 there is sewn (52) an elastic strip 54 which passes through one opening 56 of a grommet 58. The elastic strip 54 also passes through another opening 60 of the grommet 58, and then passes through the open hole 49 of the ring 50, then turns and is looped around a central bar 62 of the grommet 58, the end of the strip 54 then being sewn (64) to itself to fix that end of the strip 54 to the grommet 58.

The operativity of the size-adjustment feature should be evident from the illustration of it in FIG. 8. That is, the grommet 58 may be slid along the elastic strip 54 to provide optionality as to how much of that elastic 54 is in effect doubled on itself (for a shortness of adjustment) or a longer portion not doubled back on itself (thus giving a longer effective length to the strip 54).

Conclusion

It is thus seen that a combination article, constructed and used according to the inventive concepts herein set forth, provides novel concepts of a desirable and advantageous device, yielding the advantages of providing dress-shield operativity.

In summary as to the nature of these advantageous concepts, their inventiveness is shown by novel features of concept and construction shown herein, and by the novel concepts hereof not only being different from all the prior art known, but because the achievement is not what is or has been suggested to those of ordinary skill in the art, especially realistically considering this as comprising components which individually are well known to most persons, the entire world over. No prior art has suggested the modifications of any other prior art to achieve the novel concepts here achieved, even though dress shields of different and various natures have been known for years. This achievement is thus a substantial and advantageous departure from prior art; and particularly is the overall difference from the prior art significant when the non-obviousness is viewed by a consideration of the subject matter as a whole, as integrally incorporating the features different from the prior art, in contrast to merely those details of novelty themselves, and further in view of the prior art teaching away from a brassiere as the carrier of perspiration-absorbent material.

Accordingly, it will thus be seen from the foregoing description of the invention according to this illustrative embodiment, considered with the accompanying drawings, that the present invention provides new and useful concepts of a novel and advantageous article having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

I claim:

1. A dress shield article providing a pair of dress shields in combination with a brassiere, the brassiere having at each side a breast cup and a pair of support straps, each breast cup having an upper part, and having an outer part at a lateral side of the brassiere, that being an outer edge of the brassiere, a first one of the said support straps being an upper brassiere support strap connected, at a first location, to and extending generally upwardly and rearwardly from an upper part of the respective breast cup, and over a respective shoulder of a user, and a second one of the said support straps connected, at a second location, to and extending generally rearwardly from an outer part of the respective breast cup, and around a torso of the user, the first an second locations being spaced along the respective breast cup, and there is provided a generally cylindrical band of perspiration-absorbent material extending from each lateral side of the brassiere, the band extending generally laterally outwardly from the brassiere's first strap and generally laterally and upwardly from the brassiere's second strap, in said combination the provision that the band has an inner portion which is connected to the brassiere, which provides a connection of the band to the brassiere by a connection along the outer edge of the brassiere, between the locations therealong at which the brassiere's first strap and second strap are connected.

2. A combination article as set forth in claim 1, in which the band has end portions between which is a portion thereof which is elastically extendible; and a portion of the band extending from the brassiere's first strap is connected thereto only through end portions of an elastically extendible portion of the band, the brassiere's said first strap along said elastically extendible portion being provided to be of changeable length between said end portions to co-operate with the elastically extendible portion of the band, to provide variations in size of the band.

3. A dress shield article providing a pair of dress shields in combination with a brassiere, the brassiere having at each side a breast cup and a pair of support straps, a first one of the said support straps being an upper brassiere support strap extending generally upwardly and rearwardly from an upper part of the respective breast cup, and over a respective shoulder of a user, and a second one of the said support straps extending generally rearwardly from an outer part of the respective breast cup, and around a torso of the user, and there is provided a first dress shield panel having two opposed edges, one being an inner one of said first panel edges, and one being an outer one of said first panel edges, the inner one of said first panel edges being connected to the brassiere by connection thereto along the brassiere's said first strap and by connection thereto along the brassiere's said second strap, and forming a generally cylindrical band, for encircling a laterally inwardly portion of said shoulder of the user, and there is providing a second dress shield panel having two opposed edges, one being an inner one of said second panel edges, and one being an outer one of said second panel edges, said second panel being connected to the brassiere by a connection of the inner one of said second panel edges to the outer edge of the first panel by a connection along parts of the first panel's outer edges, forming a generally cylindrical band for encircling a laterally outward portion of the user's shoulder and an upper part of the user's respective arm, the said panels being formed of perspiration absorbent material.

4. A combination article as set forth in claim 3, in which the brassiere has an outer edge, and in which the said brassiere's support straps respectively are connected to the brassiere at a first location and a second location respectively, the said locations being spaced along the outer edge of the brassiere, and the first panel has an inner portion which is connected to the brassiere by a connection along the said outer edge of the brassiere, between the locations therealong at which the brassiere's first strap and second strap are connected.

5. A combination article as set forth in claim 3, in which the first panel has end portions between which is a portion thereof which is elastically extendible, and a portion of the inner edge of the first panel extending from the brassiere's first strap is connected thereto only through end portions of an elastically extendible portion of the first panel, the brassiere's said first strap along said elastically extendible portion being provided to be of changeable length between said end portions to co-operate with the elastically extendible portion of the first panel, to provide variations in size of the first dress shield panel.

6. A combination article as set forth in claim 4, in which the first panel has end portions between which is a portion thereof which is elastically extendible, and a portion of the inner edge of the first panel extending from the brassiere's first strap is connected thereto only through end portions of an elastically extendible portion of the first panel, the brassiere's said first strap along said elastically extendible portion being provided to be of changeable length between said end portions to co-operate with the elastically extendible portion of the first panel, to provide variations in size of the first dress shield panel.

7. A dress shield article, comprising the combination of a brassiere and a pair of dress shields connected to the brassiere, the brassiere having lateral outer sides, adjacent each of which is a breast cup, and the brassiere also having at each of its lateral outer sides an over-the-shoulder strap and a back strap for leading around a torso of a user, each of the breast cups having a laterally outer side and a laterally upper edge, in said combination in which, for a dress shield at the laterally outer side of each of the brassiere cups, there is providing the following:

(a) a first body member of the general shape of a cylindrical band, for encircling a laterally inward portion of a shoulder of the user, that first body member being formed of flat material, (b) a portion of the first body member providing a relatively forward body and a portion of the first body member providing a relatively rearward body, the first body member's relatively forward body and relatively rearward body each having upper and lower edges, and are connected to one another along one of their upper and lower edges, and (c) there is provided a second body member, formed from flat material and connected to the first body member; the second body member having end edges which are connected together to provide its shape to be in the general shape of a cylindrical band for encircling a laterally outward portion of the user's shoulder and an upper part of the user's respective arm, (d) the first body member being connected to the brassiere along three components provided by the brassiere, namely, the over-the-shoulder brassiere strap, and the outer upper edge of the brassiere cup, and an upper edge of the brassiere's back strap, (e) the second body member having a laterally-inside edge, and the first body member having a laterally-outside edge, those edges being adjacent and connected together, the said body members being formed of perspiration absorbent material.

8. A combination article as set forth in claim 7, in which the brassiere's over-the-shoulder strap and back strap are connected to the brassiere at spaced locations along the laterally outer side of the brassiere, and in which the inner portion of the relatively forward body of the first body member is also connected to the brassiere by a connection along the laterally outer side of the brassiere, between the locations therealong at which the brassiere's over-the-shoulder strap and back strap are connected.

9. A combination article as set forth in claim 7, in which the first body member has end portions between which is a portion thereof which is elastically extendible, and a portion of the first body member extending from the brassiere's over-the-shoulder strap is connected thereto only through end portions of an elastically extendible portion of the first body member, the brassiere's said over-the-shoulder strap along said elastically extendible portion being provided to be of changeable length between said end portions to co-operate with the elastically extendible portion of the first body member, to provide variations in size of the first body member.

10. A combination article as set forth in claim 8, in which the first body member has end portions between which is a portion thereof which is elastically extendible, and a portion of the first body member extending from the brassiere's over-the-shoulder strap is connected thereto only through end portions of an elastically extendible portion of the first body member, the brassiere's said over-the-shoulder strap along said elastically extendible portion being provided to be of changeable length between said end portions to co-operate with the elastically extendible portion of the first body member, to provide variations in size of the first body member.

* * * * *